US006923744B2

(12) United States Patent
Chen

(10) Patent No.: US 6,923,744 B2
(45) Date of Patent: Aug. 2, 2005

(54) TRAMPOLINE SYSTEM

(76) Inventor: Samuel Chen, Flat M, 3 floor, Kaiser Estate Phase, 3 Hok Yuen Street, Hong Kong, Kowloon (CN)

( * ) Notice: Subject to any disclaimer, the term of this patent is extended or adjusted under 35 U.S.C. 154(b) by 60 days.

(21) Appl. No.: 10/714,723

(22) Filed: Nov. 17, 2003

(65) Prior Publication Data

US 2005/0107217 A1 May 19, 2005

(51) Int. Cl.[7] ..... A63B 5/11
(52) U.S. Cl. ..... 482/27; 482/28; 482/29
(58) Field of Search ..... 482/27, 28, 29; 441/40; 5/655, 3

(56) References Cited

U.S. PATENT DOCUMENTS 5,331,329 A * 7/1994 Volkov et al. ..... 342/357.01
5,370,591 A * 12/1994 Jewell et al. ..... 482/30
5,385,518 A * 1/1995 Turner ..... 482/27
6,001,045 A * 12/1999 Gift et al. ..... 482/27
6,659,914 B2 * 12/2003 Plante ..... 482/27

* cited by examiner

*Primary Examiner*—Jerome W. Donnelly
(74) *Attorney, Agent, or Firm*—Clement Cheng

(57) ABSTRACT

A trampoline system has a frame with horizontal and supporting members raising the frame above the ground. The trampoline bed and springs have a pad body attached to the trampoline frame by straps. Each strap pair has an upper and lower strap attached to the pad body at a junction. Flange braces are mounted on the junction between the horizontal members and supporting members. A limiting member connecting each strap pair at a distance from the junction defines a pad strap gap as the distance from the junction to the limiting member. The pad strap gap is an elastic slack space sized according to the distance between the trampoline frame and the outer periphery of the trampoline pad body.

15 Claims, 3 Drawing Sheets

TRAMPOLINE SYSTEM

BACKGROUND

Trampoline accidents while rare can be minimized. Users landing on the frame can cause frame failure leading to frame collapse and user injury. Users landing on the springs can also injure themselves, but a trampoline pad can protect users. The trampoline pad protects a user from landing directly on the springs or frame of the trampoline. The trampoline pad has traditionally been attached to a trampoline frame by straps to soften a landing on the trampoline frame or trampoline springs. Many trampoline pads experience concentrated stress at the junction of the trampoline pad and the trampoline pad strap leading to premature wear.

The problem of users landing on the rigid trampoline frame has been addressed by various means. U.S. Pat. Nos. 6,001,045 and 6,139,474 to Gift shows a trampoline safety pad that includes a closed cell to cover the springs and trampoline frame. Other inventions have exchanged steel springs for elastic fabric straps to minimize user injury.

While a properly designed, properly assembled and properly loaded system of the prior art provides a small chance of structural failure and injury; a design is desired that would further minimize the chance of structural failure.

DETAILED DESCRIPTION OF THE PREFERRED EMBODIMENT

Figure 1:
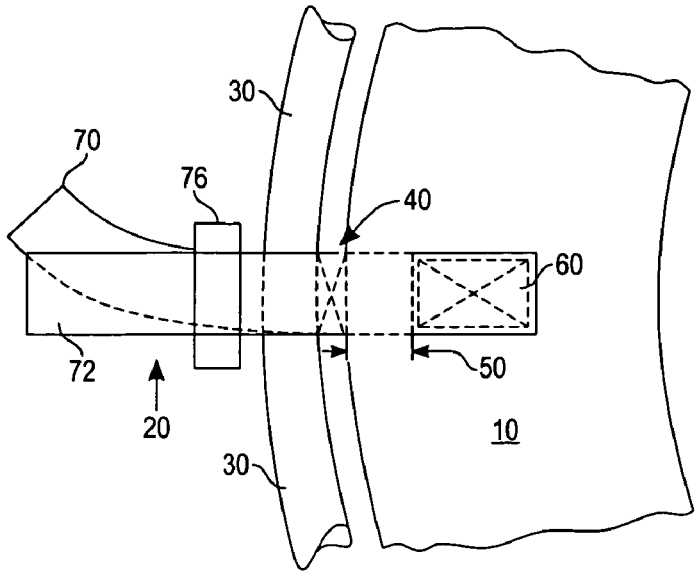
FIG. 1 is a bottom view of the trampoline strap and frame.
Figure 2:
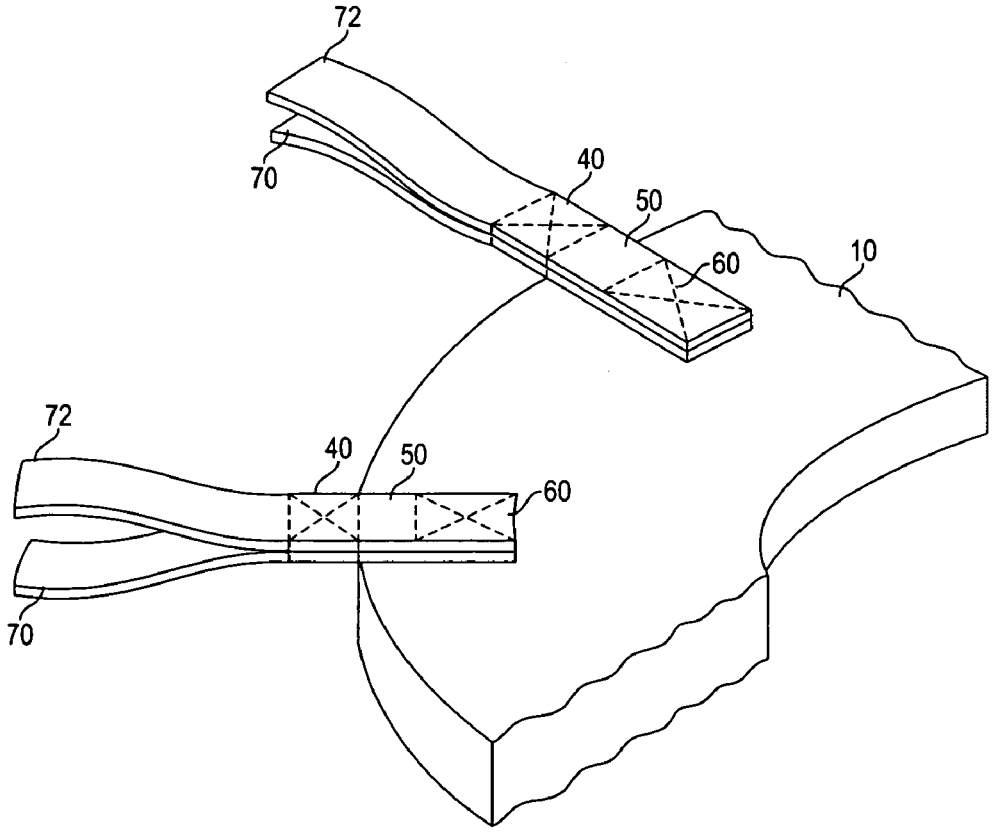
FIG. 2 is a prospective view of the trampoline pad.

The trampoline frame supports the bed 15, pad 10, springs 90 and user. The trampoline frame is commonly circular in the top plan configuration and made of horizontal tubular members 30, having a number of vertical support legs attached to the horizontal tubular members. The trampoline frame can also be rectangular. The trampoline frame retains a plurality of springs that in turn retain the trampoline surface. The present invention pad 6 rests upon the trampoline frame and springs. The trampoline frame vertical and horizontal members are commonly made of the same material and diameter.

Figure 3:
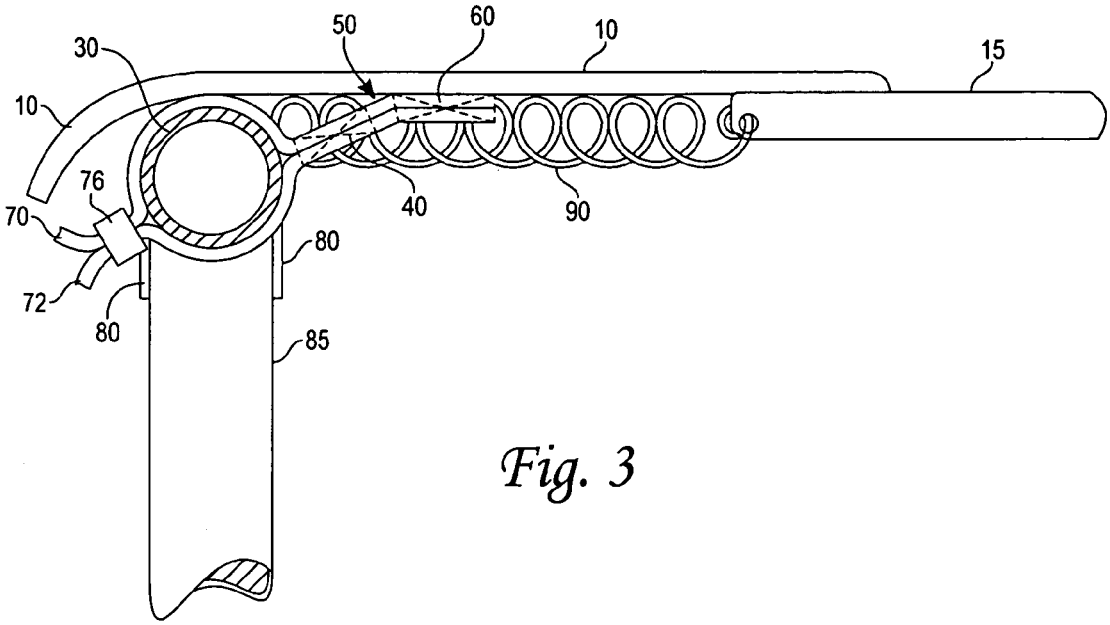
FIG. 3 is a side view of the trampoline.

The present invention trampoline straps 70, 72, FIG. 1, connects a trampoline pad body 10 to a trampoline frame 30. The trampoline pad 10 includes a strap junction 60 or other affixation that may be reinforced with a layer of fabric stitched on top of both the straps. The trampoline strap is made of elastic fabric material. The strap junction 60 is the location where a strap is stitched to the trampoline pad 10. The top strap 72 and bottom strap 70 fit around the trampoline frame 30. The pair of straps including the top strap and to the bottom strap are both stitched to the trampoline pad body 10. The trampoline pad limiting member 40 is formed so that the pair of straps are stitched together as a single strap for a length of connection. A user grasps the limiting member 40 and pulls it against the trampoline frame. A gap 50 between the limiting member 40 and the junction 60 provides an elastic shock absorbing slack spacing 50 between the pad and the frame. The straps can be tied around the trampoline frame to form a retaining connection. A user may tie the straps around the horizontal portion as seen in FIG. 3, or the vertical portion of the trampoline frame. A user may also tie the straps around the junction between the vertical and horizontal portion of the trampoline frame.

A user subsequently uses a retaining connection 76 and connects the bottom strap 70 to the top strap 72 at a location away from the frame of the trampoline 30. The retaining connection 76 can be a knot or a strap retaining device such as a buckle, a clip or hook and loop tape. For the purposes of the present device, the buckle, clip and knot are equivalent 76. A user may grasp the top and bottom strap and manually tie a knot to form the retaining connection 76.

A user ties the trampoline strap 70, 72 to the trampoline frame 30. The upper portion of the trampoline frame 30 is formed of horizontal members encircling the trampoline bed 15. As a user uses the trampoline, the user may land on the trampoline pad 10. The trampoline pad 10 is restrained by trampoline strap that has a slack space 50 that is elastic, and maintains the proper position of the trampoline pad 10 without tearing from the pad.

Figure 4:
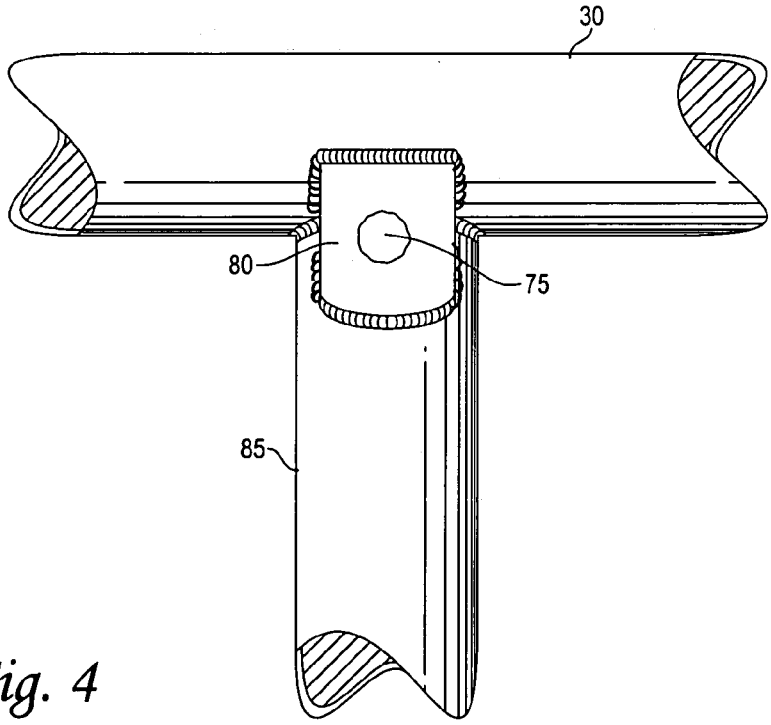
FIG. 4 is a front view of the welded T junction.
Figure 5:
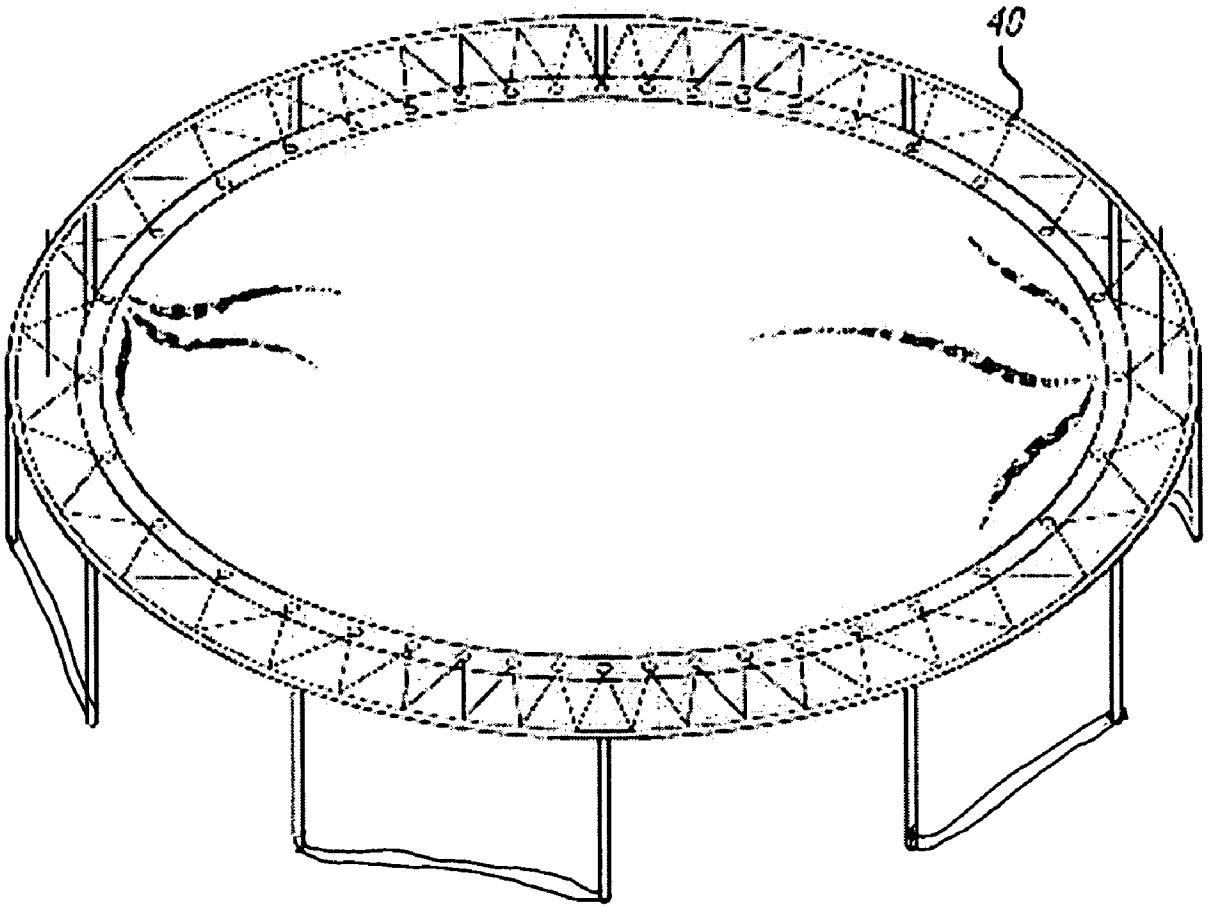
FIG. 5 is a perspective view of the invention.

The trampoline frame is formed of vertical members 85 and horizontal members 30. The vertical 85 and horizontal 30 members travel around the periphery of the trampoline bed 15. Horizontal members 30 are supported by vertical members. The horizontal members 30 connect to vertical members at a T joint connector FIG. 4 provided for interconnecting adjacent ends of each top member section. The vertical members support the T joint connectors. Supporting vertical members are generally vertical, but they may be angled also. Here, the term vertical member also includes a member that is substantially vertical. Angled supporting vertical members should be generally vertical with more than a 45 degree angle, but do not have to be 90 degrees to the ground.

The force of a user landing on the trampoline pad puts stress on the trampoline frame. The pad strap gap has an elastic slack space that absorbs some of the stress. The frame absorbs the remainder of the stress. The trampoline frame is reinforced at its T joint connections by a plurality of welding plates acting as flange braces. The flange brace plate 80 is placed on both sides of the T joint connector.

A weld plate 80 is approximately square and formed around the side of the T connector. The plate preferably includes a single hole 75 in the middle of the plate. The plate can be formed of a sheet of metal. The plate can be pressed into a shape conforming to the T connector. The plate has a periphery comprising the top edge, the bottom edge and side edges. The weld plate has a periphery capable of being welded against the T joint connector. The aperture 75 in the plate can be circular. The aperture 75 provides an edge allowing a plug weld 75 between the aperture 75 and the vertical or horizontal frame member.

The weld plate is preferably 2 mm thick before being formed into the profile of the T connector. The weld plate profile is preferably 6 mm thick after being formed into a profile of the T connector. Thus, the plate 80 preferably does not protrude from the T connector member more than 2 mm. The profile of the plate has a straight and flat upper edge with a curved lower edge having a radius proportional to the radius of the vertical member support. The lower curved edge conforms to the vertical member support and the flat upper edge conforms to the horizontal member support. The horizontal and vertical member supports are typically tubular and formed of metal.

The arc weld is preferable to weld the vertical 85 and horizontal members 30. The arc weld between the horizontal and vertical members preferably maintains an intact horizontal member while cutting a section of vertical member and welding the vertical member to the horizontal member. In figure four, the vertical member 85 is shaped to conform to the horizontal member 30. The first weld is between the vertical and horizontal member interface. The second weld is on the plate 80. The plate is shown as a rectangular piece of metal conforming to the external profile of the junction between the horizontal and vertical member. The welding plate 80 preferably receives a top weld along the top edge, and a bottom weld along the bottom edge as shown in FIG. 4. The welding plate should be roughly rectangular. Thus, the plate has a T-junction shape so that it lies flat against the profile of the trampoline frame. Preferably, the plate 80 and junction receive surface treatments such as paint so that the plate 80 is not cosmetically noticeable. A plug weld 75 on the hole 75 increases the connection between the plate and the T-junction. The plug weld 75 overlaps the junction so that the plug weld 75 protrudes through the plate and welds the plate to the junction.

Alternatively, a wire 'mig' welder can be used to form a circumferential weld along the edge of the plate. The plate can be welded in this fashion along the top, bottom, left and right sides. When a mig welder is used for a circumferential weld, the plug weld is optional.

The foregoing describes the preferred embodiments of the invention and modifications may be made without departing from the spirit and scope of the invention as set forth in the following claims.

CALL OUT LIST OF ELEMENTS

10 Trampoline Pad
15 Trampoline Bed
20 Trampoline Pad Strap
30 Trampoline Frame
30 Horizontal Member
40 Trampoline Pad Limiting Member
50 Pad Strap Gap
60 Pad Strap Affixation
70 Bottom Strap
72 Top Strap
75 Plug Weld On T Joint
76 Retaining Connection
80 Flange Brace Plate
85 Vertical Member
90 Springs

What is claimed is:

1. A trampoline pad and trampoline comprising:

a. a pad body, b. a plurality of strap pairs, each strap pair having an upper and lower strap attached to the pad body at a junction on the pad body, c. a trampoline frame, having horizontal members and supporting members raising the frame above the ground, d. a limiting member connecting each strap pair at a distance from the junction defining a pad strap gap as a predefined distance from the junction to the limiting member, wherein the pad strap gap is an elastic slack space sized according to the distance between the trampoline frame and the outer periphery of the trampoline pad body, wherein each strap pair can connect around the trampoline frame at a retaining connection, wherein the retaining connection retains the pair of straps around the trampoline frame, whereby the trampoline pad is connected to the trampoline frame with a slack space, e. a trampoline bed mounted to the trampoline frame.

2. The trampoline pad and trampoline of claim 1 wherein a buckle is the retaining connection used to allow connection of the straps to the frame.

3. The trampoline pad and trampoline of claim 1 wherein a knot is the retaining connection used to allow connection of the straps to the frame.

4. The trampoline pad and trampoline of claim 1 wherein hook and loop tape is the retaining connection used to allow connection of the straps to the frame.

5. A trampoline comprising:

a. a trampoline frame, having horizontal members and supporting members raising the frame above the ground, b. a trampoline bed mounted by springs on the horizontal members, c. a pad body encircling and covering the springs, the pad body attached to the trampoline frame by straps attached to the pad body, d. a plurality of strap pairs, each strap pair having an upper and lower strap attached to the pad body at a junction, e. a flange brace mounted on the junction between the horizontal members and supporting members.

6. The trampoline of claim 5 further comprising: a plug weld formed through the plate welding the plate to the junction of the vertical and horizontal members of the trampoline frame.

7. The trampoline of claim 5 wherein the plug weld on the plate is positioned to attach the plate to the junction of the vertical and horizontal members.

8. The trampoline of claim 5 wherein the plate receives only a top weld along the top edge, and a bottom weld along the bottom edge and a plug weld.

9. A trampoline comprising:

a. a trampoline frame, having horizontal members and supporting members raising the frame above the ground, b. a trampoline bed mounted by springs on the horizontal members, c. a pad body encircling and covering the springs, the pad body attached to the trampoline frame by straps attached to the pad body, d. a plurality of strap pairs, each strap pair having an upper and lower strap attached to the pad body at a junction, e. a flange brace mounted on the junction between the horizontal members and supporting members, f. a limiting member connecting each strap pair at a distance from the junction defining a pad strap gap as the distance from the junction to the limiting member, wherein the pad strap gap is a slack space sized according to the distance between the trampoline frame and the outer periphery of the trampoline pad body, wherein each strap pair can connect around the trampoline frame at a retaining connection, wherein the retaining connection retains the pair of straps around the trampoline frame, whereby the trampoline pad is connected to the trampoline frame with a slack space.

10. The trampoline of claim 9 further comprising: a plug weld formed through the plate welding the plate to the junction of the vertical and horizontal members of the trampoline frame.

11. The trampoline of claim 9 wherein the plug weld on the plate is positioned to attach the plate to the junction of the vertical and horizontal members.

12. The trampoline of claim 9 wherein the plate receives only a top weld along the top edge, and a bottom weld along the bottom edge and a plug weld.

13. The trampoline of claim 9 wherein a buckle is the retaining connection used to allow connection of the straps to the frame.

14. The trampoline of claim 9 wherein a knot is the retaining connection used to allow connection of the straps to the frame.

15. The trampoline of claim 9 wherein hook and loop tape is the retaining connection used to allow connection of the straps to the frame.

* * * * *